United States Patent [19]

Nagumo et al.

[11] 4,119,442

[45] Oct. 10, 1978

[54] PROCESS FOR MANUFACTURING A STEEL PRODUCT

[75] Inventors: Michihiko Nagumo; Tohru Inoue, both of Tokyo; Naoki Okumura, Yokohama, all of Japan

[73] Assignee: Nippon Steel Corporation, Tokyo, Japan

[21] Appl. No.: 746,307

[22] Filed: Dec. 1, 1976

[30] Foreign Application Priority Data

| | | | |
|---|---|---|---|
| Dec. 1, 1975 | [JP] | Japan | 50-143717 |
| Jun. 25, 1976 | [JP] | Japan | 51-74390 |
| Sep. 14, 1976 | [JP] | Japan | 51-110459 |

[51] Int. Cl.$^2$ ..... C21D 7/13

[52] U.S. Cl. ..... 148/2; 148/12 R

[58] Field of Search ..... 29/527.7; 148/2, 12; 72/365, 366

[56] References Cited

U.S. PATENT DOCUMENTS

| | | | |
|---|---|---|---|
| 3,645,801 | 2/1972 | Melloy et al. | 148/12 F |
| 3,918,999 | 11/1975 | Sekine et al. | 148/12 F |

OTHER PUBLICATIONS

The Making, Shaping and Treating of Steels, 8th Ed., 1964, pp. 631, 664–666.

*Primary Examiner*—W. Stallard

*Attorney, Agent, or Firm*—Wenderoth, Lind & Ponack

[57] ABSTRACT

A process for making a steel product so that the ratio of the initial thickness (D) of the cast slab to the final thickness (d) of the rolled product is between 2 to 6. The product has excellent mechanical properties.

5 Claims, 13 Drawing Figures

PROCESS FOR MANUFACTURING A STEEL PRODUCT

DETAILED DESCRIPTION OF THE INVENTION

This invention relates to a process for manufacturing a steel product having good quality with an excellent rolling efficiency.

According to this invention, there is provided a process for the manufacture of a steel product from a cast slab which comprises making a cast slab under the conditions that the thickness (D) of the cast slab is not more than 200 mm and the ratio of the thickness (D) of the cast slab to the thickness (d) of the product is between 2 and 6 ($2 \leqq D/d \leqq 6$), and subjecting the cast slab to rolling under the condition of $2 \leqq D/d \leqq 6$. D/d is called the reduction ratio hereafter.

The term "cast slab" herein used means either (a) a slab billet or bloom manufactured by a continuous casting operation, or (b) an as cast slab, billet or bloom manufactured by an ingot casting method.

In recent years it has been widely practiced to manufacture a steel product by using a cast slab obtained by a continuous casting operation, hereinafter referred to as "CC", because it has advantages of omission of some manufacturing steps and of enhancement of yield of product. For example, however, in a CC plate rolling the slabbing step is omitted and therefore the reduction ratio from the casting step to the final step is smaller than that of the conventional case including ingot casting, slabbing and plate rolling. Consequently, in order to exert the properties which an ordinary steel material should have, it becomes very important to study about what the lower limit of the necessary reduction ratio to be added to a cast slab should be. In the conventional plate rolling the reduction ratio is, in general, 8 or more.

In view of the above matters, the inventors have studied about the rolling conditions and the properties of the as rolled products under the conditions that the austenite grain size becomes constant after a hot rolling in order to ascertain the reduction ratio required for giving excellent properties, especially toughness to a steel material which has just been subjected to a hot rolling (which is hereafter called "as-hot-rolled" steel product) and have found the fact that the required reduction ratio is 2 to 6, more preferably 2 to 4. The reduction ratio required for obtaining the properties meeting the object of this invention is represented by $D/d$ wherein "D" is the thickness of the cast slab and "$d$" is the thickness of the final product. In this connection, they have found the fact that if the reduction ratio is too large, the quality of the steel material is deteriorated, because of elongation of inclusions. Thus they come to the conclusion that, if the thickness of the final product is predetermined, it is desirable for improving the toughness of the steel material, especially of the as-hot-rolled steel product, to make the thickness of the cast slab thinner than that of the conventional one so that the reduction ratio will meet the above range. In fact, the steel material having the most excellent properties can be obtained experimentally by cutting out thinly the portion including the center part from the conventional CC slab having the thickness of about 200 to 300 mm and then rolling the same under the conditions of this invention. In addition, if a cast slab is made such that its thickness is thinner than that of an ordinary cast slab, the center porosity and the center segregation of the cast slab should also be improved whereby the more preferable results can be obtained. The defects like vacancies included in the cast slab are defined herein as shrinkage cavities and those, in the cast slab manufactured by a continuous casting operation, are called the center porosities.

The differences between the conventional results and the results of this invention are described below.

As for the toughness, the necessary reduction ratio for the 40 or 50 Kg/mm$^2$ grade steel in the plate rolling of the CC slab is reported to be 3 to 5. However, these results are those obtained by normalizing of the material after rolled, and it has been considered that in case of the as-hot-rolled steel product, the fracture appearance transition temperature does not become lowered sufficiently unless the reduction ratio becomes at least 6. However, in such study the influence of the initial thickness of the cast slab or the contribution of the austenite grain size has not sufficiently been clarified.

The inventors have found that, if the initial thickness of the cast slab is made 200 mm or thinner, preferably 150 mm or thinner the sufficient toughness can be stably given by the small reduction ratio even to the as-hot-rolled steel product and such toughness can be balanced with the most preferable value of the ductility of the C direction (the direction perpendicular to the rolling direction) and of the Z direction (the direction of the thickness of the plate). Although the austenite grain size is constant in the normalized material, the effect of the inclusion is changed by normalizing, and it is by no means easy to presume the results about the as-hot-rooled steel product of this invention.

The reasons for the limitations of the necessary reduction ratio and of the initial thickness of the cast slab which are very important for this invention are described below.

FIG. 1 shows graphs illustrating the relation between the reduction ratio and the vEs (shelf energy of Charpy test) of L-direction (longitudinal direction), and C-direction and the reduction of area in the tensile test $\phi L$, $\phi C$, respectively, using the materials obtained by (a) cutting out a thin cast slab from 40 kg/mm$^2$ grade steel CC slab at various parts such that its final thickness becomes 20 mm when the reduction ratio is made 1 to 6, (b) heating the same, (c) rolling the same at the above mentioned reduction ratio, and (d) air-cooling the same.

Figure 7:
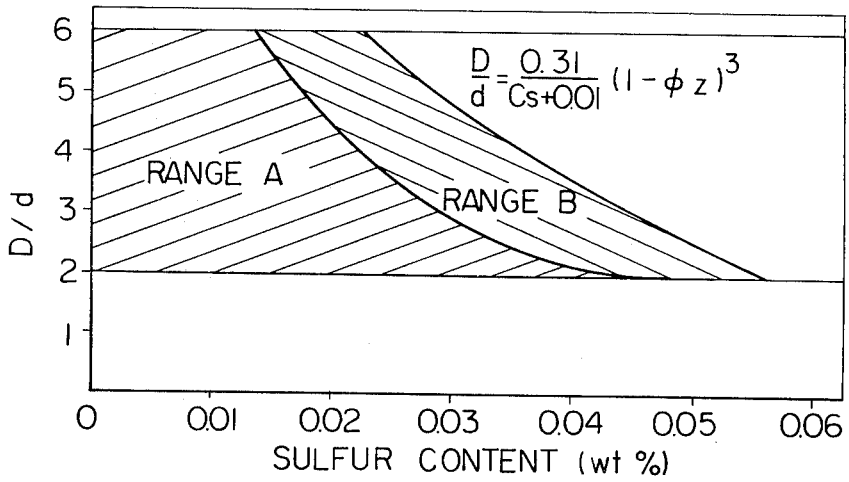

FIG. 7 is a graph showing comparison between (a) the range of allowance for the rolling conditions experimentally obtained which will fully meet the mechanical properties of the steel material and (b) the calculation formula indicated by this invention, wherein range A and B show the range of allowance for the rolling conditions meeting $\phi Z \geqq 15\%$ and the range A shows such range meeting $\phi Z \geqq 25\%$ .

Figure 1:
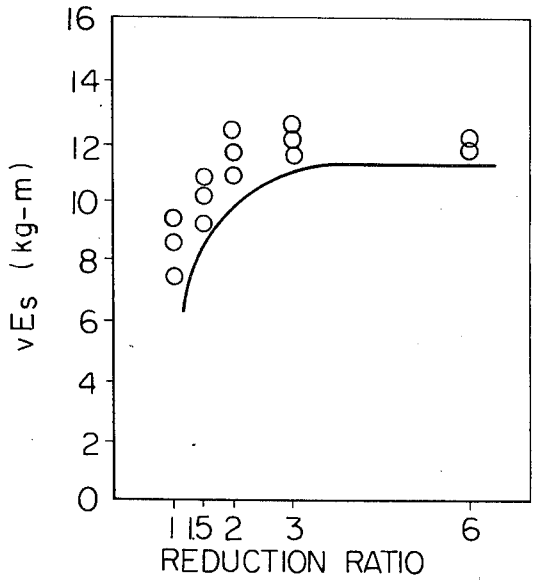
Figure 1:
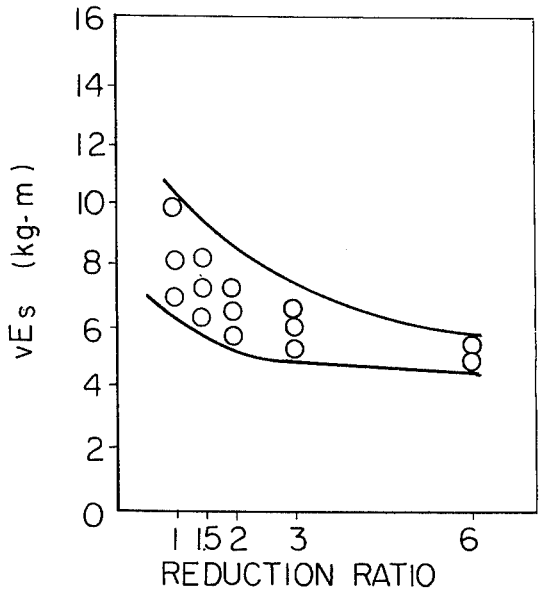
Figure 1C:
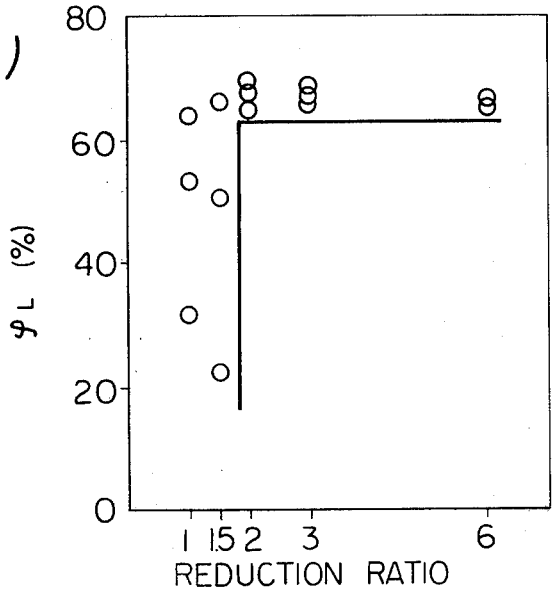
Figure 1D:
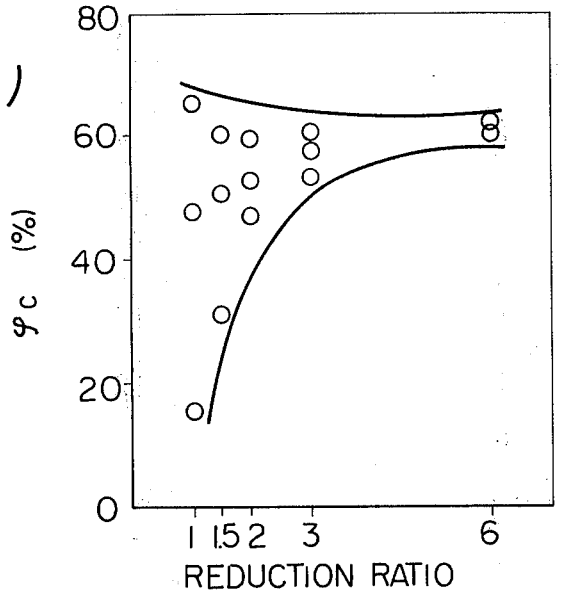
Figure 2A:
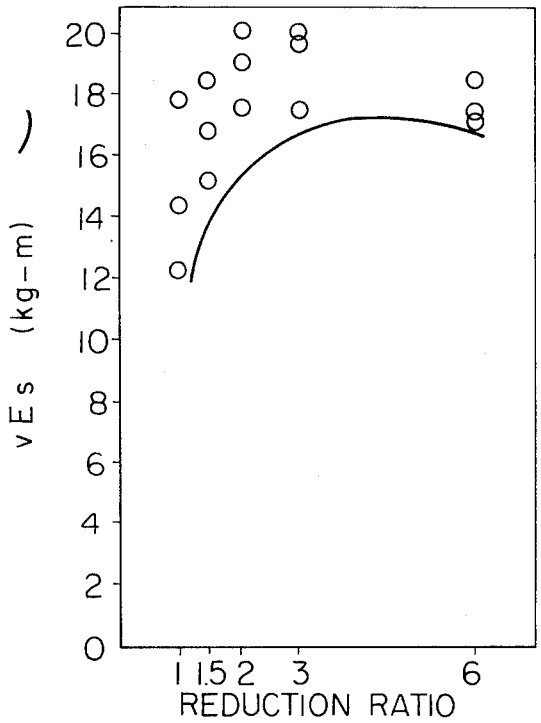
FIG. 2 is the same graphs as those of FIG. 1, except that 50 Kg/mm$^2$ grade steel CC slab is used instead of 40 Kg/mm$^2$ grade steel CC slab.
Figure 2B:
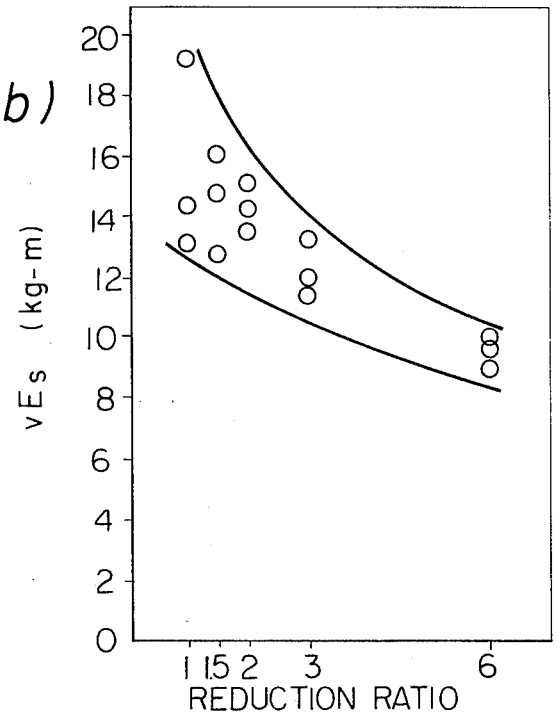
Figure 2C:
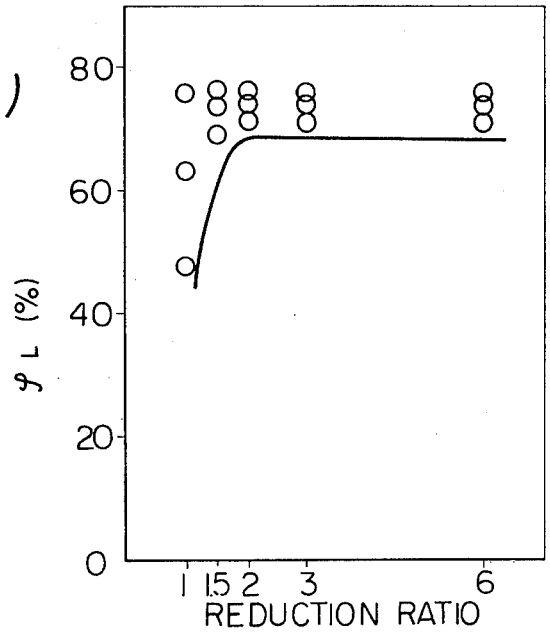
Figure 2D:
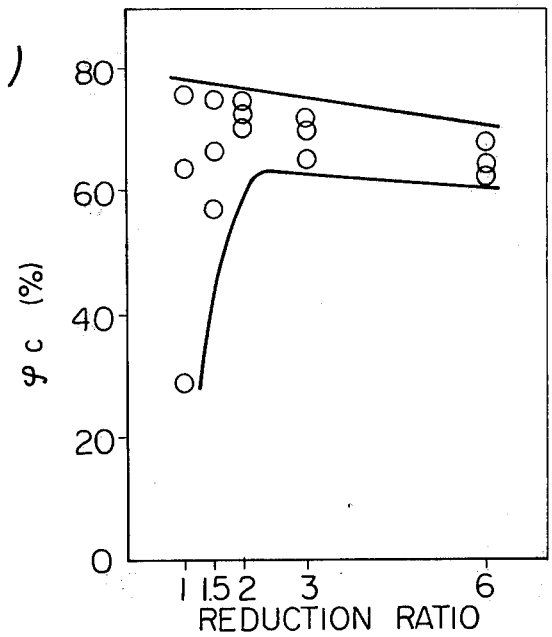

FIGS. 1 and 2 show the relations of the reduction ratio with (a) the shelf energy (vEs) of the Charpy test and (b) the reduction of area ($\phi Z$), ($\phi C$) in the tensile test regarding the 40 Kg/mm$^2$ grade steel and 50 Kg/mm$^2$ grade steel subjected to rolling so that the final thickness becomes constant by changing (a) the thickness of the cast slab before the rolling and (b) the reduction ratio.

Figure 3:
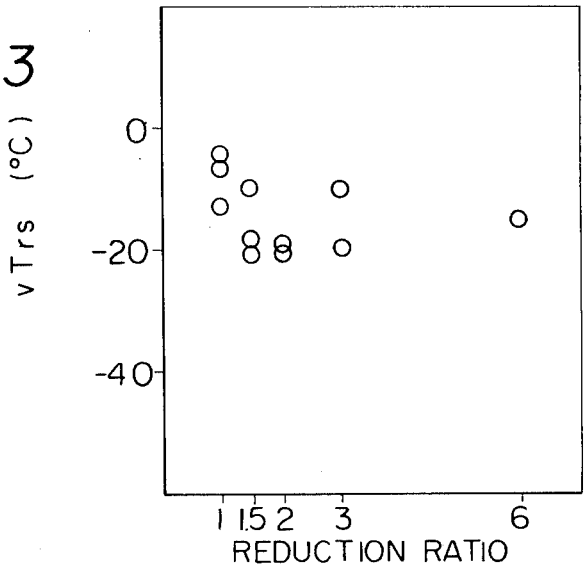
FIG. 3 is a graph showing the effect of reduction ratio upon the fracture appearance transition temperature (vTrs) with respect to 40 Kg/mm$^2$ grade steel.

In this case, the change of the thickness of the cast slab is conducted by cutting out a piece of the CC slab at various parts. It it clearly understood from FIGS. 1 and 2 that in any case the $\phi L$, $\phi C$ and the vEs of the L direction show sufficiently excellent values at the reduction ratio of 2, and they are almost constant at the reduction ratio or more than 2. On the other hand, the vEs of the C direction becomes lowered as the reduction ratio is increased. Particularly as shown in FIG. 2, in a steel having a very high vEs even under as-cast slab conditions, the vEs becomes remarkably lowered at the reduction ratio of 3 or more. As is shown in one example of FIG. 3, the fracture appearance transition temperature in the Charpy test is also sufficiently lowered at the reduction ratio of about 2, which is not changed at the reduction ratio of more than 2. The cast slab of 40 Kg/mm$^2$ grade steel contains large amount of sulfur and the center segregation and the center porosity thereof are also under bad conditions, while that of 50 Kg/mm$^2$ grade steel contains a relatively small amount of sulfur and the center segregation and the center porosity thereof are under relatively good conditions. In general, most of the cast slabs used at present have the medium properties between those of the above two cast slabs. Thus, these results show that the quality of the product will lie in the range between the two even if the cast slab condition is changed.

From the above results, it is understood that for the purpose of this invention it will suffice that the lower limit of the necessary reduction ratio is 2 while the reduction ratio of more than 6 has rather adverse effect on the steel product. Summarizing the values of L, C, vEs and $\phi L$, $\phi C$, the most perferable condition lies in the reduction ratio of 2 to 4.

Figure 4:
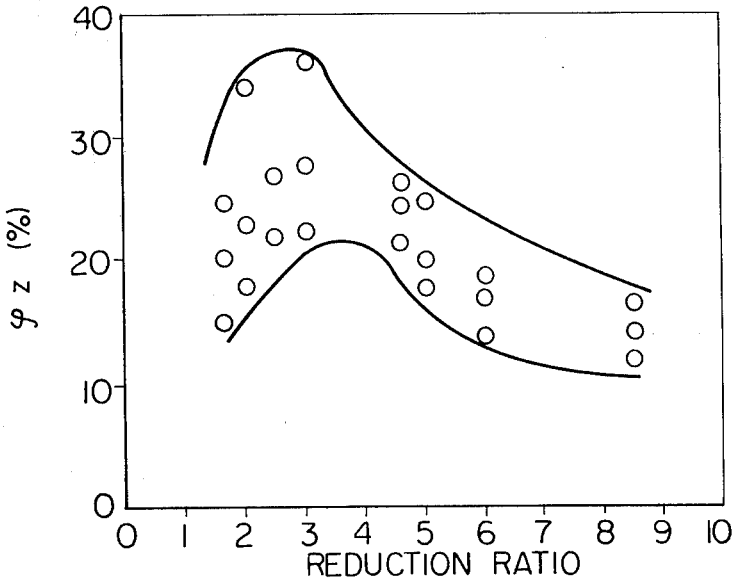
FIG. 4 is a graph showing the relation between the reduction ratio and the reduction of area of the thickness direction ($\phi z$), using a material obtained by cutting out a piece from the 40 Kg/mm$^2$ grade steel CC slab so as to include the center part, rolling the same, followed by air cooling.

As further shown in FIG. 4, the property of the direction of the thickness $\phi Z$ is maximum when the reduction ratio is 2 to 4, and as for the minimum values of the property $\phi Z$, most of the reduction of area become more than 15% when the reduction ratio is 2 to 6.

From the above results the followings can be concluded.

In order to obtain isotropic and good tensile properties and toughness, it is required that the reduction ratio is 2 to 6, more preferably, 2 to 4. In case that the reduction ratio is less than 2, the scattering of properties occurs and also the satisfactory of properties can not be obtained. On the contrary, the reduction ratio of more than 6 causes the lowering of the quality of the material.

The reasons why the thickness of the cast slab must be made so thin as this are described below.

The first reason is that in view of the above necessary reduction ratio, the reduction ratio of more than 6 is not only unnecessary but also it causes the lowering of the quality as mentioned above.

The second reason is as follows:

Considering about to what extent the effect of rolling on the center portion of the cast slab is given, it is necessary that the value of the formula $$\sqrt{R \cdot \Delta h} \,/\left(\frac{h_1 + h_2}{2}\right)$$

is adequately large, wherein the $h_1$ is the thickness of the cast slab before rolling, the $h_2$ is that after rolling, $\Delta h$ is $(h_1 - h_2)$ and R is the radius of the roll. The value is called shape factor. In a conventional rolling, the $h$ is almost constant and therefore the shape factor becomes remarkably small if the $h_1$, i.e., the initial thickness of the cast slab is large. Therefore, even if the total reduction ratio is large, the effective rolling to the center portion of the cast slab is not conducted while the plate is still thick. The prominent rolling effect to the center portion is given after the cast slab becomes thin by rolling. It is, thus, more effective to make thin the initial thickness of the cast slab.

The reason for $D \leqq 200$ mm, preferably $D \leqq 150$ mm is described below.

In case of rolling, shrinkage cavities collapse under the condition $$\sqrt{R \cdot \Delta h} \,/\left(\frac{h_1 + h_2}{2}\right) \geqq 0.8,$$

which is explained in detail afterwards. The term "collapse" herein used means that a cavity is deformed by compression and finally disappears by adherence. The ordinary plate rolling mill has $R \simeq 500$mm and $\Delta h$ max $= 35 \sim 40$ mm. Therefore, the $h_1$, namely the initial thickness meeting the above condition becomes approximately 200 mm. The reason for preferably $D \leqq 150$ is to make the shape factor preferably at least 1. This value varies with the width of the plate and the capacity of the rolling mill, which does not greatly change since the effect of R or $\Delta h$ on the shape factor is small as compared with that of D.

The third reason is as follows:

The refinement of the austenite grain is determined by each reduction ratio per pass, i.e., $\Delta h/h$ (the larger the value $\Delta h/h$ is the grain refinement is more effective). Because the $\Delta h$, namely the amount of one reduction, is determined by the capacity of the rolling mill, the value $\Delta h/h$ is small while the cast slab is still thick, which is not desirable.

In view of the above three reasons, the following conclusion can be obtained.

It is essentially significant for improving the toughness of the as-hot-rolled product at such small reduction ratio of 2 to 6 and balancing the same with such isotropic good properties as elongation and reduction of area to make the initial thickness of the cast slab thinner than the conventional thickness for a given final thickness of a product so that it will enter into the range of this invention.

In this invention it is further preferable to make finer the grain size of the cast slab prior to rolling in addition to the controlling of the initial thickness of the cast slab and the reduction ratio. That is, in a step for manufacturing a cast slab where the cast slab is cooled to a temperature below the $Ar_3$ transformation point, then reheated and subjected to the rolling, the toughness of the steel material can be further improved by controlling the reheating temperature to the range wherein the austenite grains are not coarsened and limiting the reduction ratio to $2 \leqq D/d \leqq 6$ as mentioned. The $Ar_3$ transformation point means the temperature at which the ferrite phase begins to appear in the austenite in the course of cooling.

In the ordinary hot rolling of a plate, the reheating temperature at which the austenite grains are coarsened. In the range above the coasening temperature, the austenite grains are rapidly coasened. In order to prevent the lowering of the toughness, the reduction ratio is made large and thereby the austenite grains are made fine in the ordinary manufacturing steps.

Figure 5:
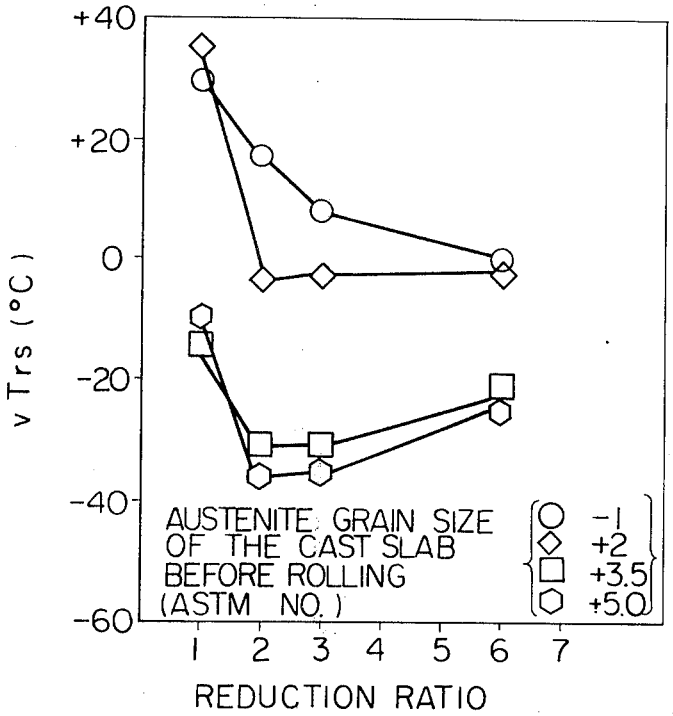
FIG. 5 is a graph showing that the toughness is good even when the reduction ratio is smaller than 6 if the austenite grain size of the cast slab before rolling is fine.
Figure 6:
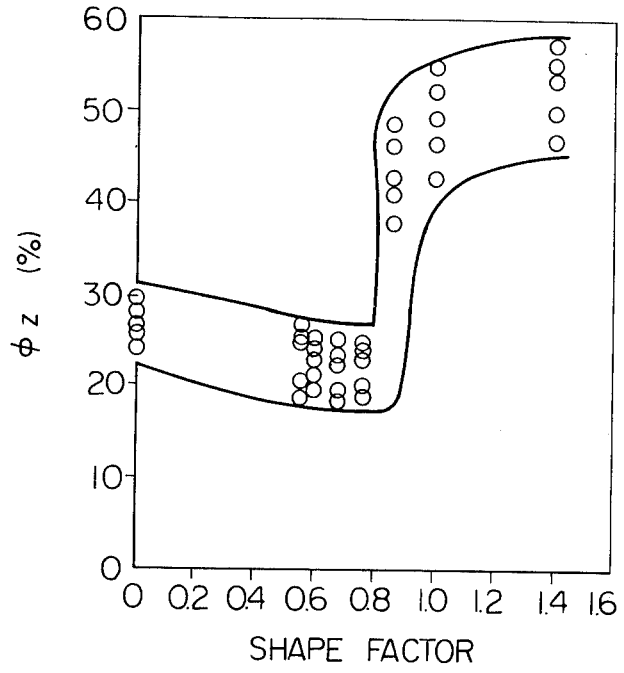
FIG. 6 is a graph showing the relation between the shape factor and the reduction of area of the thickness direction.

In this invention the reheating temperature in the reheating step is restricted not to cause grain coasening in order to prevent the lowering of the toughness which is caused by the coarsening of the grains, though it has commonly been practiced in the ordinary method to heat the cast slab up to more than the coarsening temperature such as 1250° C. If it is so restricted, however, the low temperature rolling is caused where the MnS in the cast slab becomes easily elongated and the vicinity of the boundary surface between the MnS and the matrix is strongly deformed. Therefore, it has heretofore been considered that, in the as-hot-rolled steel product, the properties of the Z direction is especially bad and normalizing treatment has often been practiced. To omit such an additional process it is necessary to control the austenite grain size in the reheating prior to the rolling as well as to restrict the reduction ratio as stated above. That is, the austenite grain size depends upon the toughness required but it is 2, more preferably 4 or more of the A STM number in order to make 0° C. or less the Charpy transition temperature of a steel ordinarily used such as a 40 $Kg/mm^2$ grade steel as shown in FIG. 5.

The above reheating temperature is less than the coasening temperature of the austenite grain size and it may be generally more than the temperature which makes the hot rolling possible.

In addition, the cast slab manufactured by a CC method has the disadvantage that the shrinkage cavities existing in the center portion thereof have an adverse influence on the mechanical properties of the steel material. Especially, the hydrogen contained in the shrinkage cavity gives rise to the delayed failure and, therefore, many efforts for eliminating the same have been made. For example, it is well-known to slow the drawing speed of the cast slab in the CC method as one of the effective means for suppressing the occurrence of the shrinkage cavities. However, it incurs extreme lowering of the productivity of the cast slab and the features of a high productivity and a low manufacturing cost of the CC method can not be sufficiently utilized.

At present, the course of rolling passes toward the product thickness "*d*" required in case of manufacturing a steel product from a cast slab by rolling has not been studied particularly with respect to the standpoint of collapse of the shrinkage cavity, and it has thus been considered that the shrinkage cavity can be collapsed if the reduction ratio of D (thickness of cast slab)/*d*(thickness of product) is large enough. However, even if the reduction ratio is made large enough, it sometimes happens that a steel material obtained by rolling of a CC cast slab shows (a) a defect detected by an ultra sonic test caused by the uncollapsed shrinkage cavity or (b) deteriorated mechanical properties.

The inventors of this invention have made studies about the relations between each rolling pass and the process of collapse in an attempt to cause the collapse of the shrinkage cavity inside the cast slab. As a result, it has been found that even if the reduction ratio is large, the shrinkage cavity is sometimes collapsed but sometimes not, depending upon the amount of reduction of each rolling pass. In other words, it has been clarified that the important factor for collapse of the shrinkage cavity by rolling is not the value of the reduction ratio but the value of the above stated shape factor. That is, the condition required for collapse of the shrinkage cavity is that the shape factor is at least 0.8, preferably at least 1, with the reduction ratio as set out before.

It is known that the shape factor is 1 or more when the compressive stress is given in the direction of rolling at the center portion of the thickness of a slab rolled. If in this case the shrinkage cavity exists, the material becomes discontinuous there whereby the distribution of the stress thereabout becomes complicated. Thus it is by no means easy to presume on the conventional technical basis that the condition for collapse of the shrinkage cavity is the shape factor of at least 1.

In FIG. 5 is shown a relation between the shape factor and the reduction of area in the tensile test of the thickness direction. In the range below the shape factor of 0.8, the reduction of area is decreased due to a white point defect caused by the uncollapsed shrinkage cavity, while in the range above the shape factor of 0.8 the reduction of area is increased because the shrinkage cavity is collapsed. The rolling pass with the shape factor of 0.8 or less has not any effect upon the collapse of the shrinkage cavity. Moreover, it tends to elongate the inclusions in the steel material and injuries the quality thereof. Accordingly, it is most preferable that the rolling is conducted with the shape factor of at least 0.8, preferably 1.0 as well as with small reduction ratio.

If there is at least one rolling pass with the shape factor of at least 0.8, the shrinkage cavity is collapsed. Accordingly, the limitation to the number of rolling pass is to be "at least one time". This rolling pass is most effective if it is conducted at the early stage of the rolling schedule. However, it may also be conducted in the middle or final stage thereof depending upon the capacity of a rolling mill or the thickness of a cast slab.

The other factor of this invention, that is, the relation between the reduction of area of the thickness direction $\phi Z$ and the content of sulfur in the steel is described below.

The inventors of this invention have clarified that the Mn and S which are unavoidable elements in the usual steel material precipitate as interdendritic MnS in planar arrangement. It has also been clarified that in case of the "as-cast" material, the cracks once formed easily propagate on the plane where MnS has precipitated, whereby properties of a cast slab, particularly toughness are extremely injured. One reason for conducting rolling is to change the arrangement of interdendritic MnS precipitates. The amount of rolling required for changing the arrangement of MnS may be so small as the reduction ratio of about 2. This fact is one of the findings of this invention based upon many studies, which is not easily conjectured from prior arts. The amount of work necessary for removing the deterioration of the material associated with MnS is the reduction ratio of about 2. Accordingly, it is possible to conduct the most efficient rolling by manufacturing a cast slab having the thickness about twice that of the product. For further detail, the deterioration of the material caused by the planar arrangement of MnS takes place as lowering of toughness, particularly as remarkable lowering of the upper shelf energy in the Charpy test. The fracture appearance transition temperature which is another indication for toughness is not affected very much, and the main factor for determining said temperature is the austenite grain size as described hereinbefore.

The MnS which is unavoidably included in a cast slab is elongated in the rolling direction in the course of rolling as is well known. Therefore, the mechanical properties of the steel material produced has remarkable anisotropy, and particularly the property in the direction of the thickness of the steel product is extremely deteriorated.

The inventors of this invention have made detailed studies about the relation between the content of sulfur and the rolling condition, and found that the $\phi Z$ depends chiefly upon the reduction ratio representing the amount of work imparted to the cast slab and upon the amount of the sulfur included in the cast slab.

It has been found that the reduction ratio is limited by the given $\phi Z$ value and sulfur content of the cast slab. This relation is represented by the formula:

$$D/d \leqq \frac{0.31}{Cs + 0.01}(1 - \phi Z)^3$$

This is one of the factors of this invention.

FIG. 7 shows the maximum valve given to $D/d$ when the $\phi Z$ is 15% and 25%.

It has been accepted that satisfactory resistance to lamellar tearing is obtained with $\phi Z$ which is not less than 25%. For parts of a steel construction which are not so stringent against lamellar tearing, $\phi Z$ not less than 15% is admittable. The wide range for allowable reduction ratio is convenient in order to make steel products of various thickness from the same size of cast slab.

The region A shows a range for the rolling condition under which the $\phi Z$ is at least 25%. The region A and the region B are the rolling conditions that $\phi Z$ is at least 15%.

The content of sulfur in the abscissa of FIG. 7 means the maximum value in the average concentration of the region to be measured according to the usual analysis in case that there are inhomogeneous distribution of sulfur in the cast slab. Accordingly, in case of CC slab, it means the sulfur content in the center segregation region.

The cast slab has only to meet the requirements of this invention, and is not limited to that produced by the present manufacturing method of the cast slab.

The above description is directed to a steel plate but this invention is applicable not only to a steel plate as a steel product but also to a shape steel, rod steel, etc. In case of the shape steel in which the thickness of the product varies with each portion, it is only required that the reduction ratio of the portion where the toughness is required is 2 to 6, preferably 2 to 4.

The following is the Examples of this invention.

EXAMPLE 1

A cast slab having the thickness of 100 mm is manufactured. From this cast slab, a steel plate of 35 mm thick is made by rolling, followed by air cooling, which meets the requirements of this invention.

The composition thereof is 0.16% C, 0.25% Si, 0.74% Mn, 0.015% S on the basis of weight.

The mechanical properties of the plate manufactured as above is shown in Table 1 in comparision with those of the conventional one.

Table 1

| Mechanical Properties | | | | | |
|---|---|---|---|---|---|
| | Slab thickness mm | Heating temp. for rolling (° C) | Thickness of final product mm | Yield strength Kg/mm² | Tensile strength Kg/mm² |
| This invention | | | | | |
| ¼t | 100 | 1050 | 35 | 29–31 | 45–49 |
| ½t | | | | 26–29 | 46 |
| Prior Art | | | | | |
| ¼t | 210 | 1050 | 35 | 27–29 | 45–46 |
| ½t | | | | 27 | 47 |
| vTrs, L ° C | vEs, L Kg-m | vEs, C Kg-m | $\phi$L % | $\phi$C % | $\phi$Z % |
| −10∼−20 | 14∼16 | 10∼11 | 60∼70 | 60∼70 | — |
| −10 | 15 | — | 60∼70 | 60∼70 | 42 |
| −15∼−20 | 12∼14 | 4∼7 | 60∼70 | 50∼60 | — |
| −20 | 13 | — | 60∼70 | 50∼60 | 18 |

Remarks: vTrs: Fracture appearance transition temperature
vEs: Shelf energy
$\phi$: Reduction of area in tensile test As is clear from the above Table the product of this invention can have desirable isotropic properties, although that of prior art may have good properties except vEs in C-direction and $\phi Z$.

EXAMPLE 2

The composition of the CC slab, a used is 0.14%C, 0.28%Si, 1.35%Mn, 0.010%S, 0.016%P on the basis of weight for 50 Kg/mm² steel. The rolling methods according to this invention and the prior art are conducted.

The result of the test comparing the mechanical properties is shown in Table 2. The specimen for the tensile test is No. 4 rod test piece of JIS. As clear from Table 2, the rolling method of this invention can remarkably improve the mechanical properties of the thickness direction.

Table 2

| | | | Mechanical Properties | | | |
|---|---|---|---|---|---|---|
| Material | Rolling method | Thickness mm | L-direction Tensile Strength Kg/mm² | L-direction Reduction of area (%) | Z-direction Tensile Strength Kg/mm² | Z-direction Reduction of area (%) |
| A | This | 20 | 54 | 72 | 52 | 48 |
| A' | invention | 30 | 53 | 70 | 52 | 53 |
| B | Prior | 20 | 54 | 73 | 38* | 10 |
| B' | art | 30 | 52 | 70 | 40*S | 13 |

Remarks: (1) L-direction is the direction of rolling. Z-direction is the direction of thickness.
(2) *is fractured before maximum stress (showing fracture stress).

EXAMPLE 3

The composition of the cast slab used is 0.14C, 0.28%Si, 1.35%Mn, 0.015%S or 0.032%S, 0.016%P on the basis of weight for 50 Kg/mm² steel. The rolling methods of this invention and of the prior art are conducted and the mechanical properties of the products obtained are compared and shown in Table 3. The specimen used for the tensile test is No. 4 rod of JIS.

Table 3

| Material | Rolling method | Sulfur content (wt %) | Mechanical properties: Reduction ratio | Austenite grain size No. (ASTM No.) of cast slab before rolling | Fracture appearance transition temperature °C | $\phi Z$ % |
|---|---|---|---|---|---|---|
| A | This | 0.015 | 3 | +3.5 | −25 | 40 |
| A' | invention | 0.032 | 3 | +2.5 | −20 | 21 |
| B | Prior | 0.015 | 8 | −0.5 | −10 | 11 |
| B' | art | 0.032 | 3 | −1.0 | +8 | 19 |

Remarks: $\phi Z$ is the reduction of area of the thickness direction.

We claim:

1. A process for the manufacture of a steel product from a cast slab wherein a cast slab of not more than 200 mm is subjected to rolling under the conditions that $2 \leqq D/d \leqq 6$ and that $$\frac{\sqrt{R(h_1 - h_2)}}{\frac{h_1 + h_2}{2}} \geqq 0.8$$

per at least one rolling pass, wherein D is the thickness of the cast slab, $d$ is the thickness of the product and $h_1$ is the thickness before rolling per each rolling pass; $h_2$ is the thickness after rolling per each rolling pass; and R is the radius of the roll.

2. The process according to claim 1 wherein the cast slab is reheated before rolling to a temperature range where the austenite grain size number thereof is at least No. 2 of ASTM.

3. The process according to claim 2 wherein the austenite grain size number is at least No. 4 of ASTM.

4. The process according to claim 1 wherein $D/d \leqq 4$.

5. The process according to claim 1 wherein the austenite grain size number of the cast slab before rolling is at least No. 2 of ASTM, and $$D/d \leqq \frac{0.31}{Cs + 0.01}(1 - \phi Z)^3,$$

wherein $\phi Z$ is the reduction of area in the tensile test of the thickness direction required; and Cs is the maximum sulfur content expressed by weight % of the cast slab.

* * * * *